United States Patent [19]

DePenti

[11] 4,243,149

[45] Jan. 6, 1981

[54] RAILROAD CAR DRAFT GEAR AND COUPLER ARRANGEMENT

[75] Inventor: Kenneth L. DePenti, Mayfield Heights, Ohio

[73] Assignee: Midland-Ross Corporation, Cleveland, Ohio

[21] Appl. No.: 916,486

[22] Filed: Jun. 19, 1978

[51] Int. Cl.[3] ..... B61E 9/00

[52] U.S. Cl. ..... 213/62 A; 213/67 R; 213/69

[58] Field of Search ..... 213/62 R, 62 A, 63, 213/64, 65, 67 R, 67 A, 69, 70, 71, 72

[56] References Cited

U.S. PATENT DOCUMENTS

| | | | |
|---|---|---|---|
| 1,971,953 | 8/1934 | Akitt | 213/69 |
| 3,613,902 | 10/1971 | Altherr | 213/72 |
| 4,128,178 | 12/1978 | DePenti et al. | 213/67 R X |

*Primary Examiner*—Randolph A. Reese

*Attorney, Agent, or Firm*—Harlan E. Hummer

[57] ABSTRACT

A rotary railroad car coupler and attached draft gear are provided with strategically located stops for maintaining a predetermined clearance between the butt end of the shank of the coupler and the adjacent front follower of the draft gear when the coupler is in a neutral position intermediate the buff and pull positions, whereby an operator can readily mount the coupler to the yoke of the draft gear, especially in a side entry pivot pin arrangement where it becomes necessary to rotate the car coupler.

2 Claims, 6 Drawing Figures

RAILROAD CAR DRAFT GEAR AND COUPLER ARRANGEMENT

BACKGROUND OF THE INVENTION

The invention is particularly well suited for use in a side entry pivot pin arrangement of a rotary F coupler, where it is important to prevent excessive compression of the draft gear against the butt end of the shank of the coupler front follower during the mounting of the coupler in the rotary mechanism within the yoke, since such compression makes it extremely difficult for an operator to properly position and pin the shank to the rotary mechanism. Moreover, such compression also causes undue wear of the butt end of the shank during dumping of a car and rotation of the draft gear relative to the coupler, which wear can radically decrease the productive life of the coupler.

Some yokes in use today have a set of stops for restricting movement of the front follower in the direction of the shank of the coupler, but these yokes require special front followers and are simply not capable of accommodating conventional front followers used in non-rotary type couplers. The invention is directed to solving this problem by the provision of an improved design which permits interchangeably using different front followers.

Briefly stated, the invention is in a car coupler and draft gear arrangement. Means are provided for maintaining the front follower of the draft gear in unbiased relation against the adjacent butt end of the coupler shank, or a desired clearance or contact between the butt end of the coupler shank and adjacent front follower. Such means includes a set of lugs disposed on the yoke and designed to engage a plurality of stops that are carried by the front follower. The stops project from a planar portion of the front follower and together with the lugs are arranged and sized to provide the desired clearance between the front follower and adjacent butt end of the shank when the coupler is in a neutral position intermediate the normal buff and pull positions.

Another aspect of the invention is the provision on the front follower of a highly improved buffing surface, the lateral curvature of which substantially equals the correspondingly measured lateral curvature of the butt end of the coupler shank.

Thus, the invention has the advantage of providing more buffing contact between the coupler and draft gear and the alternate use of conventional front followers normally used with non-rotary type couplers.

DESCRIPTION OF THE DRAWING

The following description of the invention will be better understood by having reference to the accompanying drawing, wherein.

DESCRIPTION OF THE INVENTION

Figure 1:
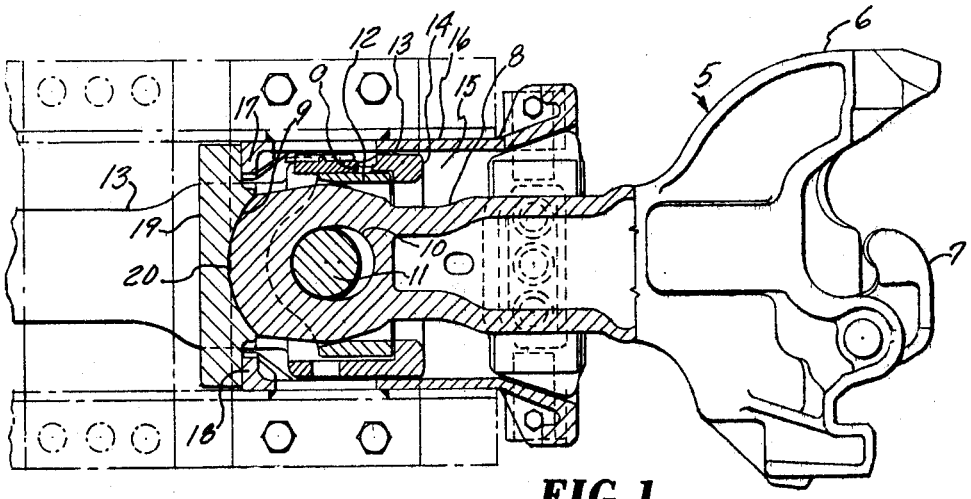
FIG. 1 is a plan view of an F type rotary coupler which is made in accordance with the invention and has certain portions removed and shown, in section, to clarify the invention.
Figure 2:
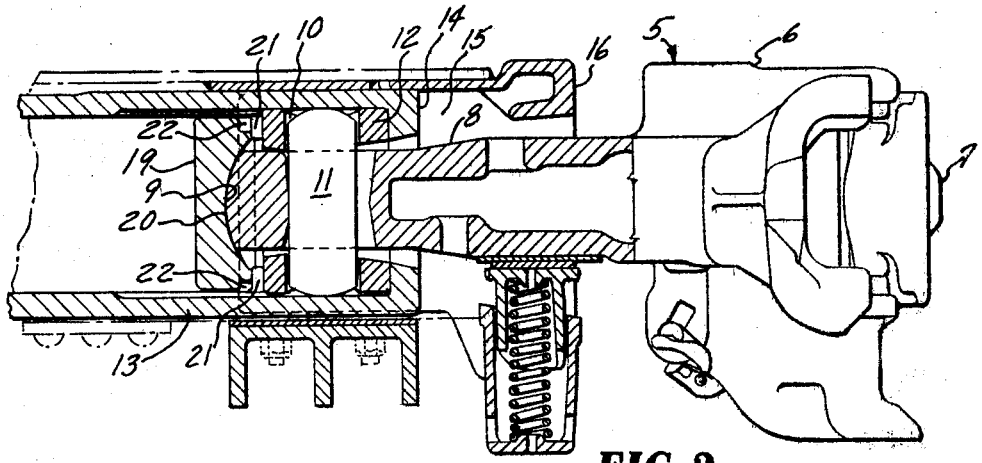
FIG. 2 is a side view of the coupler with certain portions removed and shown, in section, to clarify the invention.

With reference to FIGS. 1–5 of the drawing, there is shown an F type rotary railroad car coupler 5 having a chambered head 6 with coupling means, e.g. knuckle 7, and a shank 8 which extends rearwardly of the coupler head 6 and terminates at a spherical butt end 9. A pinhole 10 extends vertically through the shank 8 of the coupler 5 adjacent the butt end 9 when the coupler 5 is in a normally horizontal position for engaging another coupler. The pinhole 10 is designed to receive a side entry pivot pin 11 for coupling the butt end 9 of the coupler shank 8 to any suitable mechanism 12 which at least partially surrounds the butt end 9 of the coupler shank 8 and is rotatably mounted within a yoke 13 adjacent the forward end 14 of the yoke 13 closest the coupler head 6, when the coupler 5 is rotated 90° from its normal coupling position to receive the pivot pin 11 through a side opening 0 in the yoke 13. The forward end 14 of the yoke 13 and attached butt end of the shank 8, are disposed within a longitudinally extending opening or chamber 15 that is disposed in a striker 16 which is secured to the underside of a railroad car. The striker 16 is conventionally provided with a plurality of continuous side projections 17,18 for engaging and restricting axial movement of an adjacent front follower 19 in the direction of the coupler head 6, as best seen in FIG. 1. The front follower 19 is provided with a centrally disposed spherical depression or concavity 20 which is matingly configured to seat the adjacent spherical butt end 9 of the shank 8 of the coupler 5.

The yoke 13, adjacent the mechanism 12 for rotatably supporting the butt end 9 of the shank 8 within the yoke 13, is provided with a set of similar lugs 21 for engaging a plurality of similar stops 22 which are carried by the front follower 19 and project therefrom for engagement with the lugs 21 to prevent undue compression of the front follower 19 against the butt end 9 of the shank 8 when the coupler 5 is in a neutral position. For example, the stops 22 and lugs 21 are positioned and sized to maintain a clearance of about 1/64–1/32 inches between the spherical butt end 9 of the shank 8 and adjacent seat 20 of the front follower 19. Thus, the front follower 19 is held in a predetermined desired position in unbiased relation against the adjacent butt end 9 of the shank 8.

Figure 3:
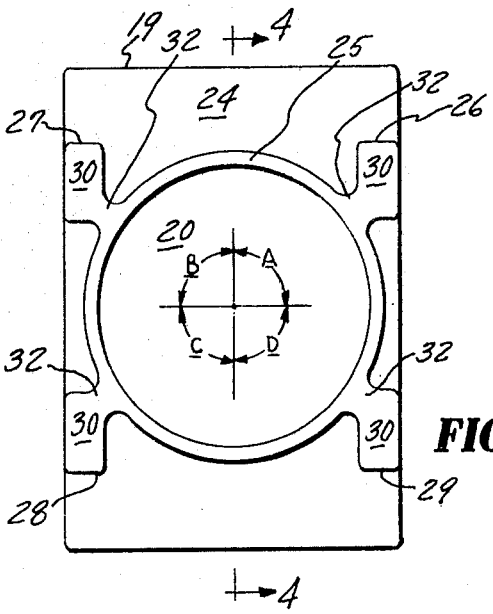
FIG. 3 is a plan view of the front follower of FIGS. 1 and 2.
Figure 4:
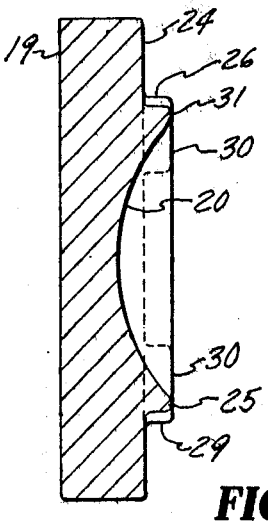
FIG. 4 is a section of the front follower viewed from the line 4—4 of FIG. 3.

The front follower 19 of FIGS. 1–5, as best seen in FIGS. 3 and 4, is specially designed for use in the rotary F coupler and comprises a rectangular shaped planar portion 24 having the centrally disposed spherical concavity 20 which is bounded by an upstanding rim 25 that projects outwardly from the planar portion 24. The concavity 20, as previously indicated, acts as the seat for the adjacent butt end 9 of the shank 8 of the coupler 5.

A plurality of generally rectangular projections 26–29 extend from the planar portion 24 adjacent the rim 25 and act as the stops 22 for engaging the lugs 21 on the yoke 13. The four stops 26–29 are disposed outside the concavity 20 and bounding rim 25 and cornerly positioned in the four projected quadrants A–D of the circular rim 25. Each of the stops 26–29 has a flat, lug engaging surface 30 which is parallel to the planar portion 24 of the front follower 19. The rim 25 has an outer ridge 31 that is in the same plane as the outer flat surfaces 30 of the stops 26–29 which are individually reinforced against lateral shear by being integrally connected with the rim 25 by similar neck portions 32.

Figure 5:
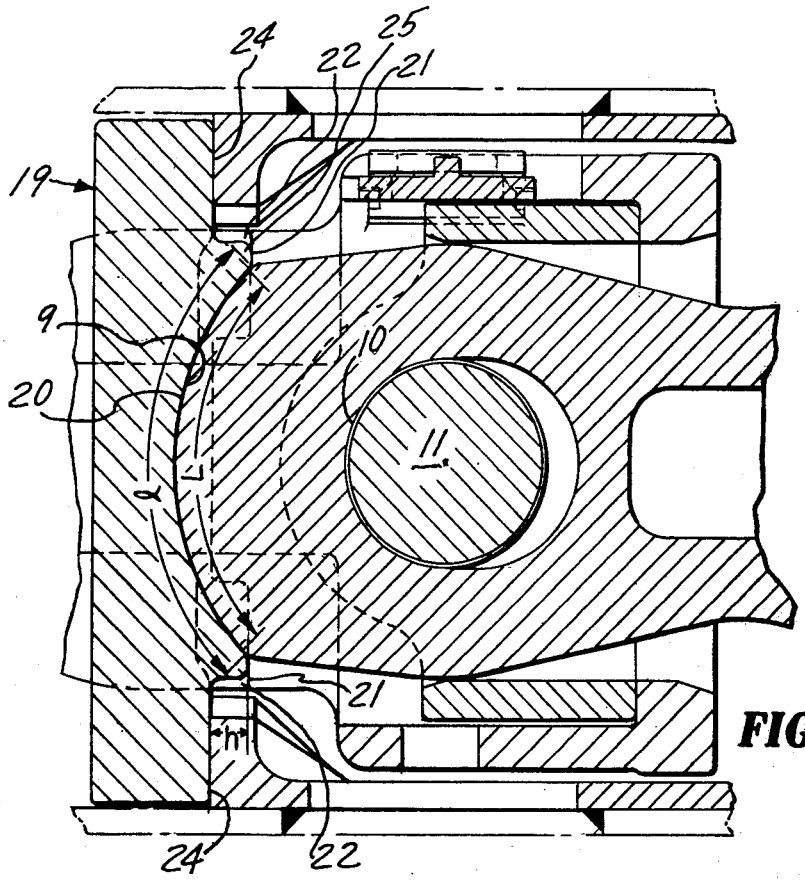
FIG. 5 is a detailed section of the front follower of FIGS. 1–4, showing the stops of the front follower in contact with the lugs of the yoke.
Figure 6:
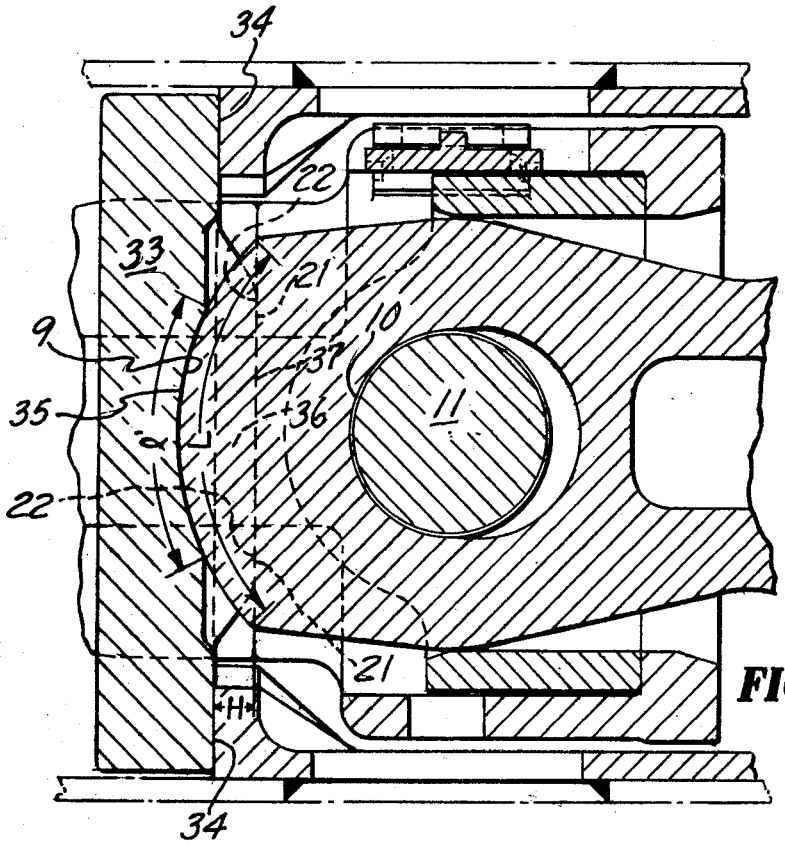
FIG. 6 is a similar, detailed section, but of a conventional front follower in contact with the lugs of the yoke.

The stops 22 of the front follower 19 and lugs 21 of the yoke 13 are positioned and sized so that, if desired, a conventional front follower 33, normally used on non-rotary type couplers, can be used in place of the special front follower 19, for comparison see FIGS. 5 and 6. The conventional front follower 33 of FIG. 6 also has a planar portion 34 with a specially curved concavity 35 which is smaller than the concave seat 20 of the special front follower 19, but is likewise centrally disposed for seating the adjacent butt end 9 of the shank 8. A pair of similar, parallel projections 36 with outer flat ridges 37, are vertically spaced adjacent the vertically uppermost and lowermost portions of the seat 35 to vertically extend and enlarge the seat 35. The flat ridges 37 of the conventional front follower 33 act as stops for engaging the lugs 21 on the yoke 13 to, likewise, prevent undue compression of the front follower 33 against the adjacent butt end 9 of the shank 8 when the coupler 5 is in the neutral position. A comparison of FIGS. 5 and 6 reveals that the height H of the flat ridges 37 above the planar portion 34 of the conventional front follower 33, is equal to the correspondingly measure height h of the flat surfaces of the stops 26–29 above the planar portion 24 of the special front follower 19.

A comparison of FIGS. 5 and 6 also shows that the length L of the curved butt end 9 of the shank 8, measured transversely of the pinhole 10, and the correspondingly measured length l of the curved seat 20 of the special front follower 19, are substantially equal, whereas the same length l′ of the curved seat 35 of the conventional front follower 33, is considerably smaller than the length L of the curved butt end 9 of the shank 8. Accordingly, the special front follower 19 provides greater buffing contact with the butt end 9 of the shank 8.

Thus, there has been provided an improved rotary coupler and draft gear arrangement, whereby the butt end of the coupler shank and adjacent seat of the front follower are maintained in predetermined desired positions relative to each other to reduce wear on the coupler during relative rotation of the coupler and draft gear and to facilitate pinning the shank of the coupler to the rotary mechanism of the yoke, when the coupler is in a neutral position and not in pull or buff.

What is claimed is:

1. A car coupler, comprising:

(a) a chambered head, including means for coupling with an opposing head of another like coupler;

(b) a shank extending from the head and terminating at a generally spherical butt end, the shank having a pinhole extending transversely therethrough adjacent the butt end for receiving a pin used to couple the shank to a rotary mechanism;

(c) a yoke having a pair of opposing longitudinally extending sidewalls between which is an opening in which the butt end of the shank is received, the yoke including (i) a plurality of lugs extending into the opening in spaced relation from the butt end of the shank to restrict movement of a rotary mechanism coupled to the shank, in a rearward direction away from the head, and (ii) an opening in one of the sidewalls through which a pin is inserted into the pinhole which is aligned with the sidewall opening when the shank is rotated about its longitudinal axis generally 90° from its position where the head is in a normal neutral position for coupling with a head of another like coupler;

(cc) a rotary mechanism mounted in the yoke for rotation about the longitudinal axis thereof, the rotary mechanism disposed between the yoke and the shank, adjacent the butt end thereof, and having a pair of spaced, aligned openings for receiving opposing ends of the pin used to couple the shank and rotary mechanism together;

(d) a front follower disposed adjacent the butt end of the shank and having a planar portion and a spherical concavity matingly configured to seat the butt end of the shank, the concavity having an area which is at least as large as the area of the butt end of the shank and being bounded by a rim which projects from the planar portion in the direction of the butt end of the shank; and (e) means coacting between the yoke and front follower for maintaining the front follower in a predetermined position adjacent the butt end of the shank where the front follower is unbiased against the butt end of the shank, when the coupler is in a neutral position intermediate buff and pull positions thereof, said means including a plurality of stops carried by the front follower and projecting from the planar portion thereof to contact the plurality of lugs carried by the yoke and hold the front follower and butt end of the shank slightly apart so that the shank can be rotated, by hand, about its longitudinal axis after insertion of the pin to couple the shank and rotary mechanism together.

2. The car coupler of claim 1, wherein the stops consist of four generally rectangular projections which are integral with the rim and connected thereto by laterally extending neck portions.

* * * * *